US005086927A

United States Patent [19]

Bach et al.

[11] Patent Number: 5,086,927

[45] Date of Patent: Feb. 11, 1992

[54] PALLET FOR HEAVY LOADS

[75] Inventors: Gary M. Bach; Carl R. Baehnman, both of Appleton, Wis.; Frederick M. Holt, Jr., Midlothian, Va.; Terry T. Highfield, Sheffield, Ala.

[73] Assignee: Reynolds Consumer Products, Inc., Appleton, Wis.

[21] Appl. No.: 624,734

[22] Filed: Dec. 6, 1990

[51] Int. Cl.[5] ..... B65D 85/66

[52] U.S. Cl. ..... 206/597; 108/55.3; 108/55.5; 206/389; 206/599

[58] Field of Search ..... 206/303, 386, 595-600, 206/389; 108/53.1, 55.1, 55.3, 55.5, 56.1

[56] References Cited

U.S. PATENT DOCUMENTS

| | | | |
|---|---|---|---|
| 1,897,598 | 2/1933 | Wyman, Jr. | 206/303 |
| 3,187,690 | 6/1965 | Desbois | 108/56.1 |
| 3,524,415 | 8/1970 | Heiman | 108/55.1 |
| 3,603,273 | 9/1971 | Riffe | 108/55.5 |
| 3,880,093 | 4/1975 | Schott | 108/55 |
| 4,000,704 | 1/1977 | Griffin, Jr. | 108/55.3 |
| 4,253,569 | 3/1981 | O'Connor | 206/389 |
| 4,413,737 | 11/1983 | Wind | 206/599 |
| 4,480,748 | 11/1984 | Wind | 206/386 |
| 4,809,851 | 3/1989 | Oestreich, Jr. | 206/600 |
| 4,829,909 | 5/1989 | Mandel | 108/55.5 |

FOREIGN PATENT DOCUMENTS

| | | | |
|---|---|---|---|
| 0224559 | 7/1985 | German Democratic Rep. | 206/386 |

*Primary Examiner*—Jimmy G. Foster
*Attorney, Agent, or Firm*—Alan T. McDonald

[57] ABSTRACT

A molded plastic pallet for holding coiled aluminum stock, the pallet including an octagonal shaped platform on which the coiled material rests, a pair of grooves in the bottom of the platform, a centering ring on the top of the platform and a pair of legs on the bottom of the platform, coiled material being banded to the pallet by wrapping tie strips around the coiled stock and the grooves.

10 Claims, 2 Drawing Sheets

PALLET FOR HEAVY LOADS

TECHNICAL FIELD

The present invention relates generally to pallets, more particularly to a plastic pallet for securing and transporting heavy, coiled materials.

BACKGROUND OF THE INVENTION

Pallets have been used in the handling and shipping of various goods for many years. Pallets are used to protect various goods, to provide support during handling, and to facilitate the movement of such goods with machines such as forklifts.

Typical pallets include a surface or platform on which the goods may be set, as well as some type of legs which hold the platform off the ground. Maintaining a space between the platform and ground allows the pallets to be easily picked up and moved. With heavy goods, a forklift is generally used to move the goods since the fork can simply be slid between the platform and ground, and then the goods may be lifted.

Originally, pallets were made from wood, but now many other materials such as molded plastics are being used. Examples of such pallets are shown in Schott, U.S. Pat. No. 3,880,093 and Wind, U.S. Pat. No. 4,413,737 as shown in these patents, pallets have been made from molded plastic to provide durability and to facilitate manufacture. Plastic pallets can also be recycled if damaged.

Plastic pallets have been formed into various shapes and types, but are not adequate for various uses. When used to transport heavy coiled stock such as aluminum, the edges of the pallet often crack when the pallet is tipped on its side to release the coil from the pallet if the pallet is substantially greater in size than the rolled stock. Additionally, the legs do not always provide adequate support for heavy materials.

SUMMARY OF THE PRESENT INVENTION

The present invention provides a plastic pallet for heavy coiled stock having an octagonal shape generally corresponding to the diameter of the coil which permits the pallet to be tipped by an upender to release the coiled stock without breaking the edges of the pallet. The octagonal shape also prevents the pallet from rolling when tipped on its side. In order to provide adequate support on the bottom of the pallet, the legs have been formed as an integral part of the pallet and extend across the bottom of the pallet platform. Each of the legs is continuous and provides consistent support across the bottom of the pallet. Since the legs extend lengthwise in a parallel direction, there is ample room for insertion of the tongs on a forklift.

In accordance with another aspect of the invention, banding grooves are provided in the bottom of the platform which terminate in grooves in the edges of the platform. The banding grooves are of a length corresponding to the diameter of the coiled stock so that the banding straps used to hold the coiled stock on the surface of the platform aids in centering the coiled stock on the pallet.

Other principal features and advantages of the invention will become apparent to those skilled in the art upon review of the following drawings, the detailed description and the appended claims.

DETAILED DESCRIPTION OF THE DRAWINGS

A preferred exemplary embodiment of the invention will be described in conjunction with the appended drawing, wherein like numerals denote like elements, and:

Figure 1:
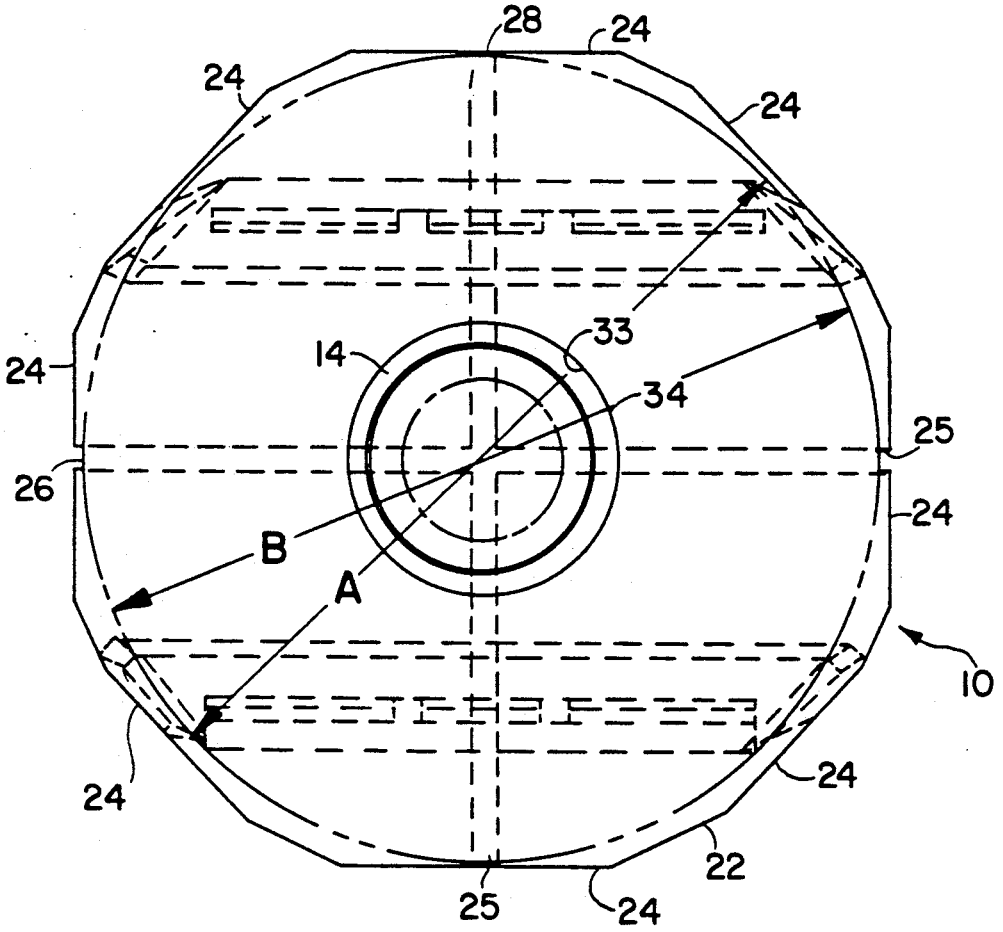
FIG. 1 is a top view of a pallet of the invention.
Figure 2:
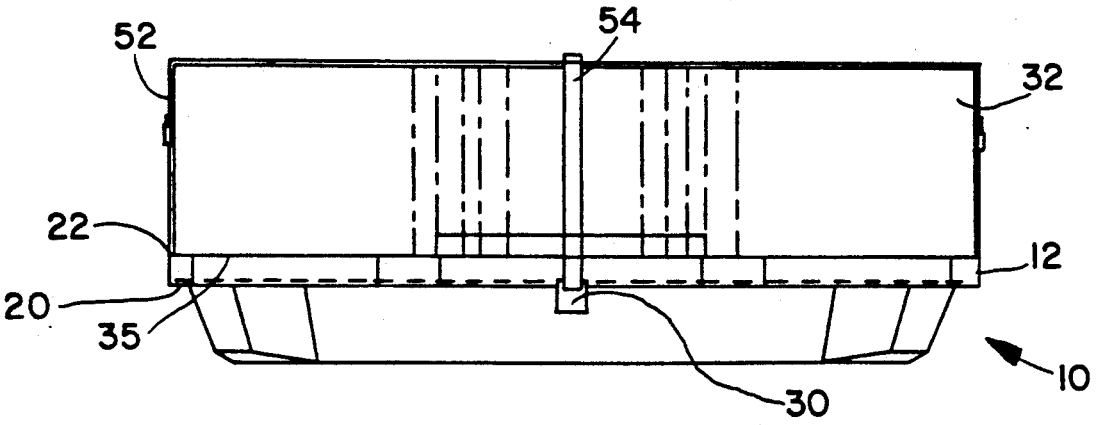
FIG. 2 is a side view showing a heavy coiled roll banded to the pallet.
Figure 3:
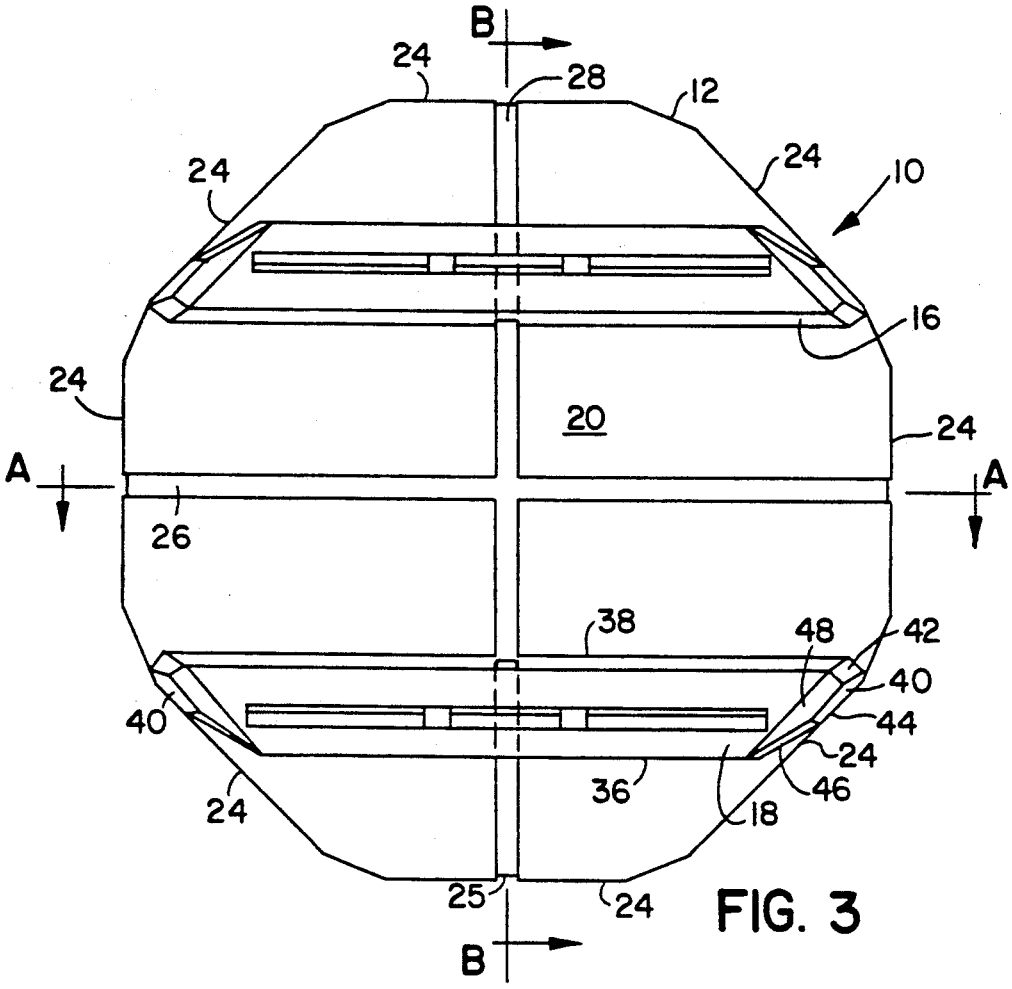
FIG. 3 is a bottom view of the pallet.
Figure 4:
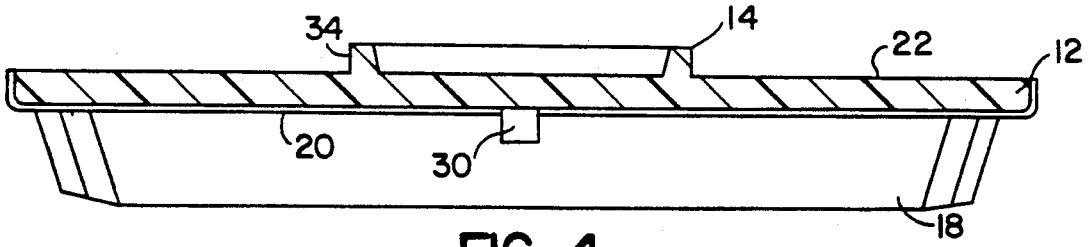
FIG. 4 is a cross-sectional view of the pallet taken along line A—A of FIG. 3.
Figure 5:
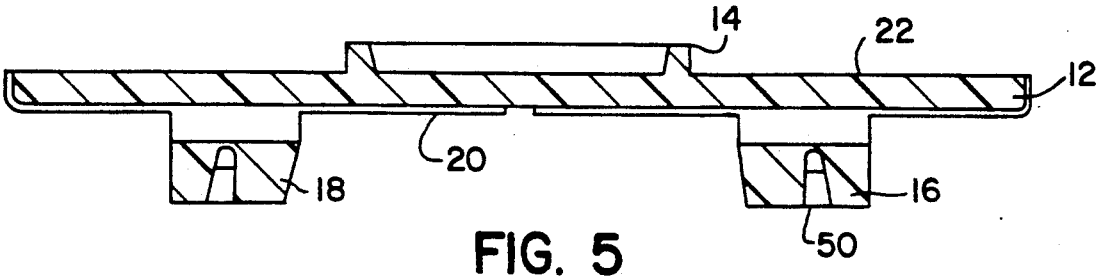
FIG. 5 is a cross-sectional view taken along line B—B of FIG. 3.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purposes of description and should not be regarded as limiting.

DETAILED DESCRIPTION OF THE PREFERRED EMBODIMENTS

Referring to the figures in the drawings, a plastic pallet 10 in accordance with the present invention comprises a platform 12, having a first leg 16, and a second leg 18. The platform 12 is generally octagonal in shape and is molded as an integral unit having the legs 16 and 18 extending from the lower surface 20 of platform 12. The platform 12 has eight edges 15 which are tangent to a circle "A" having a diameter ¼" to ½" larger than the diameter "B" of the coil stock 32. The inner diameter will vary in two inch increments from 40" to 80" to accommodate coil stock of approximately the same diameter. A centering ring 14 may be provided on platform 12 for centering the coil stock on the platform.

Platform 12 includes a top surface 22, lower surface 20, and eight edges or sides 24. In lower surface 20 are a first groove 26 and a second groove 28 which are recessed in the bottom of the platform 12 and located in a perpendicular relation to each other. The groove 26 runs parallel to legs 16 and 18 and passes through the center of lower surface 20 of platform 12. Groove 28 also passes through the center of lower surface 20, but runs perpendicular to groove 26 and to legs 16 and 18. Respective apertures 30 are generally square in cross section and extend through legs 16 and 18' in alignment with groove 28. The grooves 26 and 28 terminate in slots 25 provided in the edges 24 at each end of the grooves 26 and 28. The slots 25 are an ⅛" to ¼" deep to accommodate the bands 52 and 54. It should be noted that the slots 25 are generally aligned with the outside diameter of the coiled stock.

The centering ring 14 may be provided on the top of the pallet 10 to help to hold the coiled stock in place. The centering ring 14 is molded as an integral part of platform 12. When platform 12 is loaded with coiled stock 32, the centering ring 14 will extend partially through the center of the coiled stock. Centering ring 14 preferably extends ½" to two inches above top surface 22. An external edge 34 of centering ring 14 abuts against an inside cylindrical surface 33 of coiled stock 32 so that coiled stock 32 cannot shift along top surface 22 when pallet 10 is moved. The external edge may be chamfered to aid in centering the coiled stock on the pallet. A flat surface 35 of coiled stock 32 rests against top surface 22. Although a full ring has been described for the centering ring, a centering ring formed by pins or cross members may also be used.

Legs 16 and 18 extend downward from bottom surface 20. Both legs have the same shape and are disposed in parallel arrangement on opposite sides of pallet 10. Each leg runs lengthwise, perpendicular to groove 28 and is continuous completely across bottom surface 20 of platform 12. Each leg runs parallel to groove 26 and is located approximately midway between groove 26 and the outermost edge of platform 12. Preferably, legs 16 and 18 extend at least three inches from bottom surface 20 to provide adequate space for a fork lift truck.

Each leg includes an outer wall 36 and a longer inner wall 38. Each leg also comprises respective ends 40. Ends 40 are multi-surfaced ends including short surface 42, an exterior surface 44, a tapered surface 46 and a lower surface 48. The end surfaces abut one rounded exterior. Inset in each leg is a recessed slot 50 which extends upwardly from a bottom surface 52 into the center of each leg. Slot 50 runs longitudinally along the bottom of each leg for a substantial portion of the length of each leg.

When coiled stock 32 is placed upon pallet 10, the flat side 35 of coiled stock 32 rests on top surface 22 of pallet 10. Tie straps or bands 52 and 54 are used to securely hold the coiled material against top surface 22. A first tie strap or band 52 is positioned so that it runs within groove 26, wraps around the slots 25 in the edges of pallet 10 and continues over the top of the coiled material so that the coiled material is squeezed downward against top surface 22 when tie strap or band 52 is pulled tight. Similarly, a second tie strap 54 is positioned so that it runs within groove 28 and passes through apertures 30 in legs 16 and 18. Tie strap 54 also continues around the outer edge of the platform in slots 25 and over the top of coiled material 32 so that it holds the coiled material 32 against top surface 22. It should be noted that the slots 25 are generally aligned with the coil so that the bands 52 and 54 center the coil on the pallet. Various tie straps can be used, including metal tie bands, so long as the tie straps can be tightened in order to hold the coiled material securely against top surface 22 of pallet 10.

Thus, it should be apparent that there has been provided in accordance with the present invention a advantages set forth above. Although the invention has been described in conjunction with specific embodiments thereof, it is evident that many alternatives, modifications and variations will be apparent to those skilled in the art. Accordingly, it is intended to variations that fall within the spirit and broad scope of the appended claims.

The embodiments of the invention in which an exclusive property or privilege is claimed are defined as follows:

1. A molded pallet for securely holding coiled materials, comprising:
   - a platform having eight sides and a generally octagonal shape configured to securely hold a coiled material having coils which extend into close proximity to each side,
   - respective legs extending from a lower surface of said platform and disposed lengthwise in parallel arrangement,
   - a first groove recessed in said lower surface of said platform and disposed parallel to said legs,
   - a second groove recessed in said lower surface and disposed perpendicular to said legs wherein said first and second grooves function to hold tie straps which secure said coiled material to said pallet, and
   - respective apertures in communication with said second groove and extending through said legs whereby a tie strap can be inserted through said legs and remain within said second groove.

2. The pallet of claim 1, wherein where are two legs, each substantially greater in length than in width and each containing an outer side and an inner side, said inner side being longer than said outer side.

3. The pallet of claim 1, including a centering ring is disposed in the center of a top surface of said platform, said ring extends less than two inches from said top surface.

4. The pallet of claim 1, wherein each leg extends at least three inches from said lower surface of said platform.

5. A molded one piece pallet supporting a heavy metal coiled stock having a predetermined diameter, said pallet comprising:
   - a generally octagonal platform having a top surface and a bottom surface, each pair of opposing sides of said platform having an inside diameter therebetween being substantially equal to the outside diameter of the coiled stock, and
   - a pair of legs molded on the bottom of said platform for supporting the platform.

6. The pallet according to claim 5, wherein said platform includes a pair of banding grooves in said bottom surface.

7. The pallet according to claim 6, wherein one of said grooves is parallel to said legs and the other of said grooves is perpendicular to said legs.

8. The pallet according to claim 7, wherein said platform includes a recess in each of said legs located in alignment with said grooves.

9. The pallet according to claim 8, including a centering ring on said top surface formed integral with said pallet.

10. The pallet according to claim 9 wherein each side groove is located in alignment with the outside surface of the coiled stock whereby a band wrapped around said grooves and said coiled stock will center said coil stock on said pallet.

* * * * *